United States Patent [19]

Miller

[11] 3,939,502

[45] Feb. 24, 1976

[54] DISPOSABLE PAD

[76] Inventor: Marjorie A. Miller, Rte. 2 Box 414A, Sleepy Hollow Road, Dundee, Ill. 60118

[22] Filed: Aug. 5, 1974

[21] Appl. No.: 494,458

[52] U.S. Cl. ..... 4/113
[51] Int. Cl.[2] ..... A61G 9/00
[58] Field of Search ..... 4/1, 113, 112, 142, 254, 4/237

[56] References Cited

UNITED STATES PATENTS

| | | | |
|---|---|---|---|
| 2,260,437 | 10/1941 | Chambers | 4/113 X |
| 2,481,427 | 9/1949 | Hunter | 4/113 |
| 2,501,844 | 3/1950 | Ervin | 4/113 |
| 2,817,093 | 12/1957 | Rode | 4/113 |
| 2,886,827 | 5/1959 | Washington | 4/113 |
| 3,084,348 | 4/1963 | Parker et al. | 4/113 |
| 3,100,303 | 8/1963 | Coulter | 4/113 |
| 3,381,315 | 5/1968 | Glassberg | 4/142 |
| 3,514,793 | 6/1970 | West | 4/113 |

*Primary Examiner*—Henry K. Artis
*Attorney, Agent, or Firm*—Lockwood, Dewey, Zickert & Alex

[57] ABSTRACT

A disposable comfort pad for bedpans having a pad member shaped to cover the flesh-engaging seat portion of a bed pan. The bottom or underside of the pad member, at least in the distal end areas and bight portion area, is coated with pressure sensitive adhesive which is shielded prior to use of the pad by sheet material which can be readily stripped away. At least one, and preferably three, pul tabs or loops project from the pad member for use in removing the pad from a bedpan. The pad member has an inexpensive filling within an envelope or cover formed of soft, thin, plastic film.

6 Claims, 4 Drawing Figures

DISPOSABLE PAD

This invention relates to a novel disposable comfort pad for use on bedpans. The object of the invention, generally stated, is the provision of disposable (i.e. inexpensive) comfort pads for use on bedpans which serve the purpose of making the use of pans much less objectionable to patients and bedridden persons.

Bedpans are an unavoidable necessity and one of the objectionable features is the feel of the hard and usually cold surface that they present on the flesh of the user. The disposable bedpan pads of the present invention will overcome this objection and add greatly to the comfort of the users of bedpans. Since they are sufficiently inexpensive to be disposable, they do not present any sanitation problems or add to the work associated with emptying and cleaning bed pans.

The basic element of the disposable bedpan pads provided by the present invention is a pad member which is shaped to cover the flesh-engaging seat portion of a bedpan. Since bedpans come in conventional or standard sizes and shapes (i.e. childs, standard or orthopedic) the pad members can be made so as to provide the proper fit for this limited number of sizes or types. The undersides of the pad members are provided with retention means in the form of pressure sensitive adhesive which is initially covered with removable strip or sheet shielding material. When the time comes to use one of the pads on a bedpan, the sheet material is removed and thereupon the adhesive is exposed so that it can engage the surface of the bedpan and retain the pad member in the proper position. While it is preferred to have the major portion of the underside of pad members covered with the retention means in the form of a protected or shielded coating of pressure sensitive adhesive, it is acceptable to reduce the area of the pressure sensitive coating so as to have deposits thereof adjacent only the distal ends of the pad member and at the bight portion thereof.

It is also highly desirable that one or more pull tabs or loops be affixed to the pad members so that attendants can readily and conveniently remove used disposable pads from bedpans without having to engage the pad members themselves and thereby become soiled in doing so.

With respect to the pad members themselves, it is highly important that they present a soft warm-feeling surface to the flesh of the patient or user. It has been found that this highly desirable feature can be achieved by employing soft thin plastic film in the form of an envelope or covering which is filled with inexpensive padding material of the type commercially available and produced from cellulose or wood fiber materials or from various expanded or foamed plastic materials of known type. The pad members may also be formed of padding in the form of opposing sheets of thin plastic film encapsulating or trapping air bubbles therebetween.

For a more complete understanding of the nature and scope of the invention reference may now be had to the following detailed description of a presently preferred embodiment in conjunction with the accompanying drawings wherein.

Figure 1:
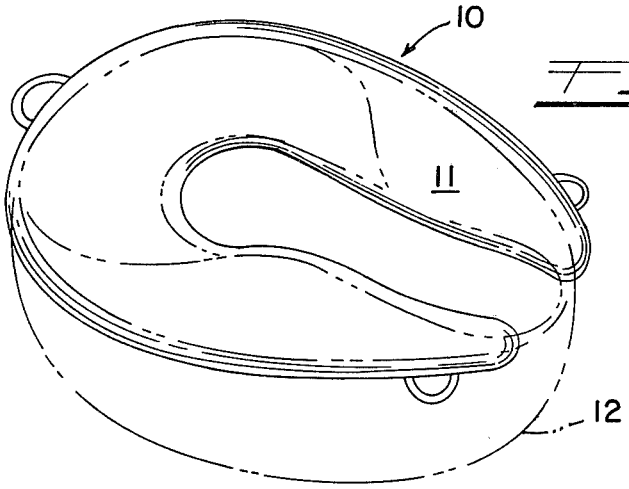
FIG. 1 is a top perspective view showing a disposable comfort bedpan made in accordance with the present invention in place on a conventional bedpan.

In the drawings a disposable comfort pad for bedpans is indicated generally at 10 and comprises a generally C-shaped or horse collar shaped pad member 11 of a size and shape to fit or cover the flesh-engaging top surface or seat portion of a bedpan indicated generally at 12. The pad member 11 is formed with a covering or envelope of thin plastic film 13 such as thin polyethylene, polyvinylchloride, polyvinylacetate, cellophane, etc. The cover or envelope 13 is filled with a padding or wadding material 14 of an inexpensive commercially available type and may be formed of cellulose fibers or of an expanded or foamed plastic material, either in sheet or crumb (granular) form. For example, the cellulosic padding material that is commonly used for disposable diapers serves as a satisfactory material for the padding or stuffing 14. Foamed natural or synthetic rubber in the form of granules or crumbs serves as another suitable filler material. It will be understood that the envelope 13 can be formed in several ways either from a single piece of material or from multiple pieces. The envelope or cover 13 can be completely formed but with the outer bight portion at the rear, for example, being left open for insertion of the filler material. In another procedure the padding or filler material 14 may be preformed to the proper shape and then the thin pliable plastic film 13 used to cover the padding or filler relying on adhesive or pressure sensitive tape to complete the cover or envelope.

In order to retain the disposable comfort pad 10 in place on the bedpan 12 the underside of the pad member 11 is provided with a coating of pressure-sensitive adhesive material of known type as indicated at 15. In the embodiment shown the adhesive material 15 covers substantially all of the underside surface of the padding member 11 except for the inner C or U-shaped margin designated at 16. The adhesive-free margin 16 is provided in the order of approximately one-half inch in width so that when the pad member 11 is in place on the bedpan 12 this margin 16 can extend over the inner rim 17 (FIG. 2) on the seat of the bedpan. The flange or marginal portion 16 is capable of bending or flexing downwardly under the weight of the user's flesh so as to lap over and cover the inner edge or rim 17 of the bedpan.

As initially produced or manufactured the disposable bedpan pads 10 will have the adhesive 15 shielded or protected by a strippable sheet material 18 such as paper or plastic. It will be understood that when the disposable pad 10 is to be used, this shielding sheet or strip material 18 is removed and then the attendant will properly position the exposed adhesive 15 on the upper or seat surface of the bedpan.

In order to facilitate the removal of one of the disposable comfort pads 10 from a bedpan 12 after use the pad member 11 is provided with lift or pull tabs or loops 20—20. Preferably two of these are provided on or adjacent the distal ends of the pad member 11 and one at the bight portion thereof. The inner ends of the tabs or loops 20 are suitably attached as by stapling, heat sealing or stitching to adjacent firm portions the pad member 11. In use the attendant merely has to grasp one or more of the loops or tabs 20 and lift thereon with one hand while the other hand holds the bedpan 12 down. In this way the attendant does not have to engage or touch any used portion of the pad member 11, either the top surface which has engaged the users flesh or the bottom or underside which is coated with the adhesive 15.

Figure 2:
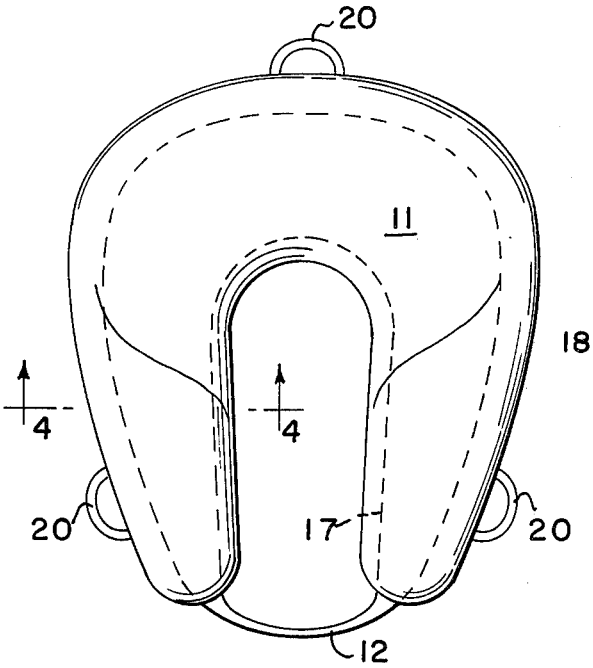
FIG. 2 is a top plan view of the disposable comfort pad of FIG. 1 in place on the bedpan.
Figure 3:
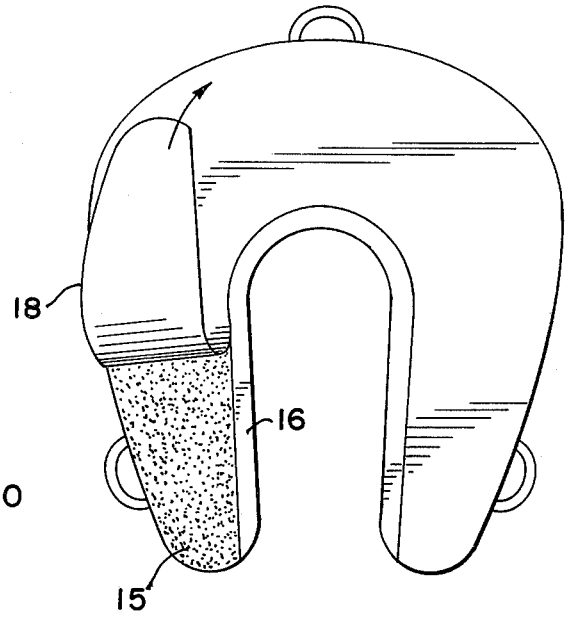
FIG. 3 is a bottom plan view of the disposable comfort pad shown in FIG. 1 prior to its application to a bedpan and with one end of the piece or sheet of adhesive-shielding material partially stripped away.
Figure 4:
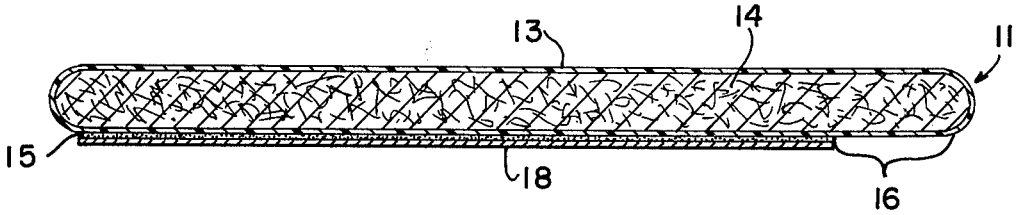
FIG. 4 is a sectional view on magnified scale taken on line 4—4 of FIG. 2.

It will be seen from FIGS. 1 and 2 that the outer margin or edge of the pad member 11 extends slightly over or beyond the seat portion of the bedpan 12 so as to engage and adhere to the side wall for a short distance. This helps to insure that the pad 10 will not slide or wrinkle when a patient is unable to raise up but has to be turned on his or her side and then rolled over onto the bedpan. Furthermore, by having the pad member extended over onto the side wall of the bedpan there is little chance for the removal tabs 20 contacting the patient's body.

It will be understood that certain changes may be made in the construction of the disposable comfort pad 10 without departing from the spirit and scope of the invention. For example, instead of coating substantially all of the underside of the pad member 11 with adhesive 15, excepting the margin 16, the adhesive 15 may be confined to three separate areas, the distal ends of the pad member and to the bight portion thereof. In this modification it will only be necessary to cover these three adhesive-coated areas with relatively small pieces of shielding or strippable material 18.

As another change, the pad member 11 may be formed from commercially available packaging material of the type wherein air bubbles or pockets are trapped or encapsulated between opposing pieces of soft, thin plastic film.

I claim:

1. A disposable bedpan pad comprising a pad member having generally the shape and size of the flesh-engaging seat portion of a bedpan, and shielded pressure sensitive retention means on the underside of said pad member for releasably anchoring said pad member in place on said seat portion, said retention means being located at least at the distal portions and at the bight portion of said pad and being shielded prior to use of said bedpan pad by removable sheet material so as to expose pressure sensitive adhesive material.

2. The disposable bedpan pad of claim 1 wherein said shielded pressure sensitive retention means covers substantially the entire bedpan engaging surface of said pad member leaving a margin around the inner edge of said pad member not covered by said retention means.

3. The disposable bedpan pad of claim 1 wherein there is at least one tab projecting from said pad member for use in removing said disposable bedpan pad from a bedpan without contacting any portion of said pad member.

4. The disposable bedpan pad of claim 3 wherein there are three of said tabs with two projecting from the distal ends of said pad member and one projecting from the bight portion thereof.

5. The disposable bedpan pad of claim 1 wherein said pad member comprises a soft thin film envelope or cover and an inexpensive compressible padding material.

6. The disposable bedpan pad of claim 1 wherein said pad member comprises opposing pieces of soft thin plastic film with bubbles or pockets of air trapped therebetween.

* * * * *